United States Patent [19]

Muncheryan

[11] 4,180,810

[45] Dec. 25, 1979

[54] SILENT AWAKENING SYSTEM

[76] Inventor: Hrand M. Muncheryan, 1735 N. Morningside St., Orange, Calif. 92667

[21] Appl. No.: 869,797

[22] Filed: Jan. 16, 1978

[51] Int. Cl.[2] ..... G08B 1/08

[52] U.S. Cl. ..... 340/407; 340/148; 340/309.1

[58] Field of Search ..... 340/309.1, 407, 148; 58/152 B

[56] References Cited

U.S. PATENT DOCUMENTS

| | | | |
|---|---|---|---|
| 3,786,628 | 1/1974 | Fossard | 340/407 |
| 4,028,882 | 1/1977 | Muncheryan | 340/407 |

*Primary Examiner*—Harold I. Pitts

[57] ABSTRACT

A silent awakening system operable either by receiving a sound-alarm signal, such as that from a fire-detection alarm, or by the actuation thereof by means of an alarm-triggering means of an electric clock, with the sound-producing mechanism of said clock being deactivated. The system is used to awaken deaf persons as well as persons of normal hearing, without disturbing others sleeping in the same room or nearby. It comprises a sound-receiving means which converts said sound to an electric signal to operate an electric relay, an electrical signal-processing circuit connected to said relay and actuated thereby, an electric alarm clock to set the time of awakening with the alarm-triggering means thereof mechanically connected to a switch means disposed in said electrical signal-processing circuit, and an awakening module electrically connected to said electrical signal-processing circuit to receive, for operation thereof, a processed current either through said electric relay or through said switch means actuated by the alarm-triggering means of said clock.

13 Claims, 5 Drawing Figures

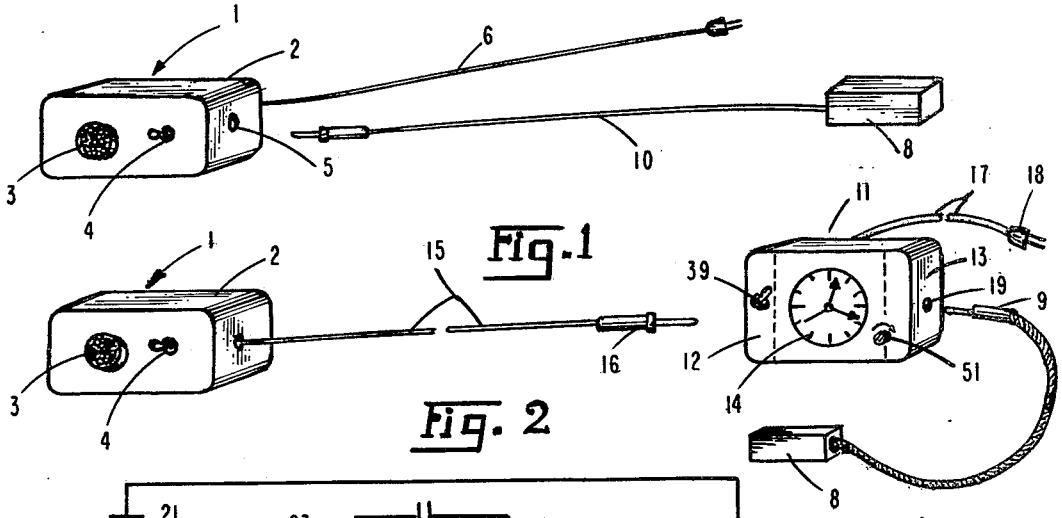
Fig. 1
Fig. 2
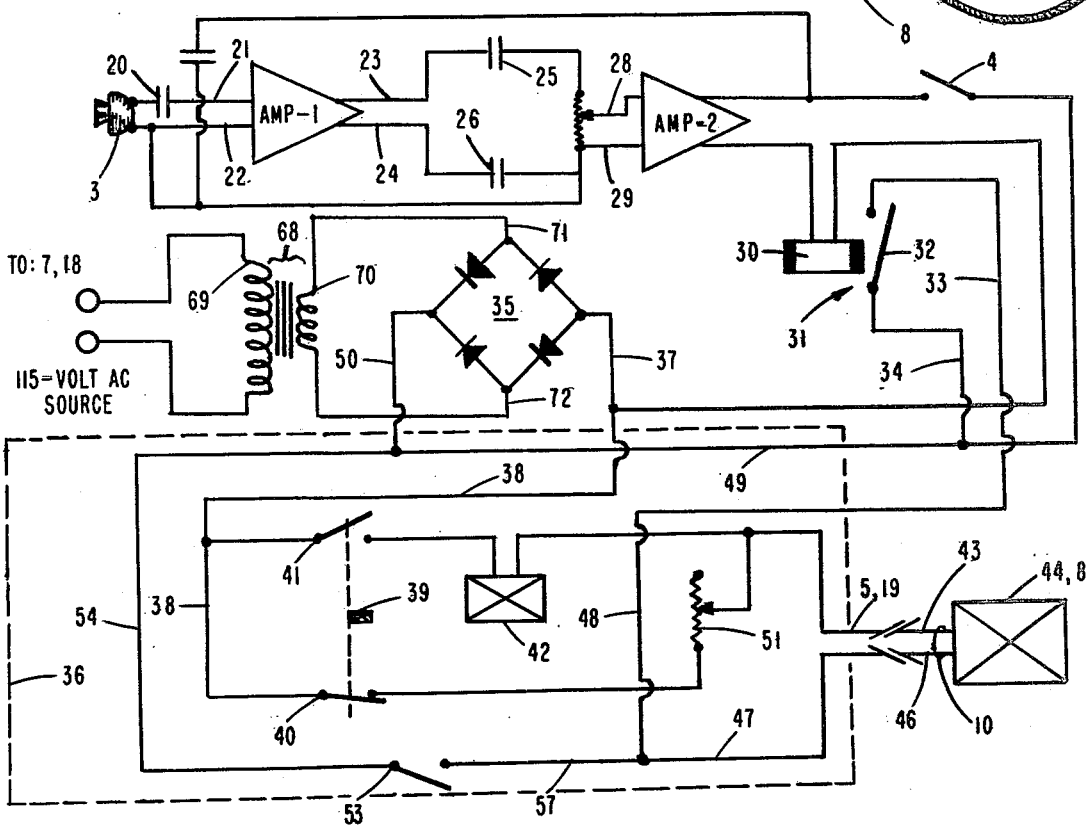
Fig. 3
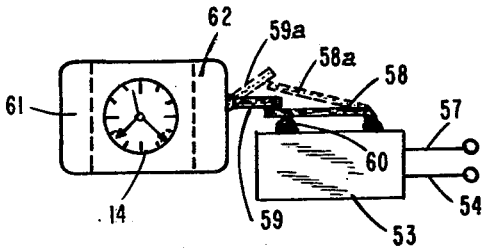
Fig. 4
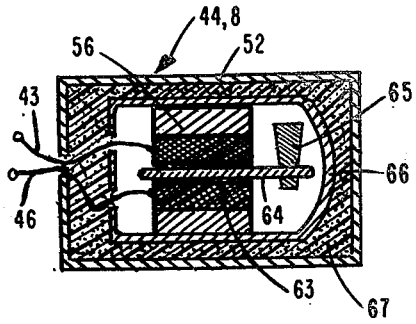
Fig. 5

SILENT AWAKENING SYSTEM

The present invention is generally related to a device for awakening a sleeping person and is more particularly concerned with a device adapted to operate either by the sound of a fire-detector alarm or by the actuation of the alarm-triggering means of an electric clock set to a predetermined time of the day for awakening.

BACKGROUND OF THE INVENTION

At the present time, the general method of awakening of a person at a predetermined time is the use of an electric alarm clock, which triggers a sound alarm at a time set for awakening; this is accomplished by the stimulation of a person's auditory mechanism. However, if that person's auditory mechanism is not functioning properly, he cannot hear the sound and cannot be awakened by such means. One other method is the use of a flashing light operable by a clock set to actuate the flashing of the light at a desired time of awakening. The disadvantage of the former method is that the setting off of the alarm sound by the clock awakens other persons sleeping in the same or nearby room. The disadvantage of the latter method is that the sleeping person must be facing the flashing light at about the time of awakening; if the sleeping person is lying on his back or on his side away from the flashing light direction, the awakening action of the flashing light will be ineffective. Furthermore, the flashing light may also awaken other persons facing the flashing light.

To overcome these shortcomings of the existing methods, the present invention is developed to produce an effective and physical stimulating signal to awaken both deaf persons and persons of normal hearing, regardless of the position in which they are sleeping in bed. The present method affects only the person using the device and no one else. One such device is the applicant's prior invention using radio waves emanating from a means disposed either in a fire-detector system or in a clock, either of which could be located hundreds of feet away from the awakening unit, which is either placed under a bed pillow at night during sleeping or in a person's pocket during the day while working remotely from the alarm signal produced by either the fire detector or the clock. This invention is described and claimed in the applicant's patent application, Ser. No. 769,344, filed Feb. 16, 1977, with all the claims allowed and now pending for the issuance of a patent. In contrast with the operative characteristics of that device, the present invention employs audio-frequency signals emanating from a smoke-fire detector or other sounds to energize the awakening module, the signal-processing circuit thereof being remotely located in the sound detector of the system or in the electric clock, so that either the sound detector or the clock can be used independently of each other or jointly (by incident) to produce a silent awakening stimulus in the awakening module to awaken the sleeping person. Furthermore, the cost of manufacture of a system of this type is relatively lower than the radio-wave operated device and is within the financial means of an average working person, deaf persons, senior citizens, or others of low income. The system is also small and compact and easily portable from one place to another when desired.

SUMMARY OF THE INVENTION

The present invention is a system to silently alert a person to the dangers of toxic gases, smoke, fire alarm and other sounds which are particularly inaudible to deaf or partially deaf persons. The invention is also provided with means connected to and actuated by the alarm mechanism of an electric clock to produce electric signals which are transmitted to an awakening device placed under the pillow of a sleeping person to transmit thereto undulatory pulsations for awakening him. To achieve this purpose, the invention is provided with an electric circuit therein adapted to receive an acoustic signal, to convert said acoustic signal into an electric signal, and then to amplify it. The amplified output from this circuit is fed to an electric relay switch means connected in the electric circuit of said awakening device for energization thereof.

Another object of the invention is the provision of an awakening module which is connected to said electric relay switch means through an electric current source, which is provided, in the circuit thereof, with a current interrupter to produce a pulsative current flow through said awakening module.

A further object of the invention is the provision in said awakening module of a rotating means having a shaft with a weight attached to one terminal portion thereof and eccentrically mounted thereon for producing an unbalanced shaft rotation in said awakening module and thereby to create an undulatory or vibratory motion in said awakening module.

A still further object of the invention is to convert the undulatory or vibratory motion in said awakening module into pulsative undulations by the interrupted current fed into the rotating means of said awakening module, whereby a pulsative, undulatory motion is transmitted to the sleeping person through the pillow under which said awakening module is normally located for effective, stimulative operation thereof.

Another object of the invention is the provision of a means in said awakening module whereby said module can be connected either to the sound receiving and amplifying circuit of the system or to the alarm-producing mechanism of an electric clock to trigger a current flow into the awakening module circuit for awakening operation thereof.

A further object of the invention is to utilize any 115-volt 60-cycle household current for the operation of the awakening system, after said household current is properly processed in the system circuit by a means adapted to convert said household current into a current of a character utilizable by said awakening module.

One other object of the invention is the provision in the electric circuit thereof means to channel the current in said electric circuit into two channels, one channel passing therethrough a continuous current and the other producing an interrupted current therein prior to passing said current therethrough.

BRIEF DESCRIPTION OF THE DRAWINGS

Other objects and advantages of the invention will become more apparent from the specification taken in conjunction with the accompanying drawings, in which:

FIG. 1 is a plan view of the sound-operated silent alerting device together with an awakening module detachably connected thereto, forming the silent awakening system.

FIG. 2 is a plan view of a modified embodiment of the invention wherein both the sound-operated device and the awakening module are electrically connected through an electric alarm clock, whereby said awakening module can be operated either by the sound-operated alerting device or by the triggering of the alarm mechanism of the clock when set to go off at a predetermined time of the day.

FIG. 3 is the electrical circuit of the entire invention, illustrated as a partial block diagram.

FIG. 4 shows schematically the attachment of the triggering mechanism lever of the clock to the switch lever of a microswitch.

FIG. 5 is a sectional view of the awakening module, showing the constructional structure thereof.

DETAILED DESCTIPTION OF THE INVENTION

Referring to the drawing shown in FIG. 1, numeral 1 designates a sound-operated switch means, having a housing 2, a sound detector or microphone 3, an electric On-Off toggle switch 4, a receptacle or phone jack 5, and an electric cord 6, which receives an electric current from a 115-volt 60-cycle household current source through the plug 7. An awakening unit or module 8 is detachably connected to the sound-operated switch means 1 through plug 9 and cord 10 to receive energizing current therefrom. An electronic circuit to amplify the electrical signals and to use the amplified current thereof to operate a relay therein is enclosed within the housing 2, and will be presently discussed in detail using the schematic circuit diagram shown in FIG. 3.

When a sound signal is received by microphone 3, the sound signal is converted thereby into an electrical signal and fed into the electric circuit therein, wherein said electrical signal is amplified, electrically processed and fed to the telephone jack 5, from which the processed signal is transmitted to the awakening unit 8 through plug 9 disposed at the distal end of electric cord 10 for operation of said awakening unit 8.

In FIG. 2, the sound-operated switch means 1 is provided with the same electrical components as that shown in FIG. 1, with the exception that subsequent to the amplification of the electrical signal therein it does not undergo further electrical processing, since the section of the circuit for processing of the amplified signal is located in the clock housing 11 compartments designated by the broken lines 12 and 13; furthermore, the sound-operated switch means 1 is electrically connected to the electric clock 14 circuit through a cord 15, one end of which is permanently attached to the current output portion of a circuit within the housing 2 and the opposite end thereof is detachably connected to the electric clock 14 circuit through the plug 16, which is inserted into the mating socket (not shown in the figure) located in the left-side wall of housing 11. The electric clock 14 is energized by a 115-volt alternating current received through the cord 17 and plug 18 connected to an external source of 60-cycle current. The housing 11 is provided with a socket or telephone jack 19 in one wall thereof to accept the plug 9 of the awakening module 8, which receives an energizing current from the circuit connected to the current energizing the clock 14. The operation of the awakening system is detailed in the accompanying description of the schematic circuit diagram of the entire system displayed in FIG. 3.

In the schematic circuit diagram shown in FIG. 3, the silent awakening system receives through microphone 3 an audio signal in the form of a sound from any source, such as a smoke/fire detector alarm, a door bell, a telephone bell, or a similar sound source, and transforms the sound signal into an electrical signal of varying frequency, depending on the nature of the sound; the electrical signal passes through capacitor 20 and through leads 21 and 22 into a preamplifier AMP-1. The electrical output of preamplifier AMP-1 is fed through conductors 23 and 24 and capacitors 25 and 26 into a variable resistor 27, which is used to adjust the sensitivity of the system to incoming sound signals. The electrical signal from resistor 27 is fed through conductors 28 and 29 into a terminal amplifier AMP-2, in which the electrical signal is further amplified and transmitted into the solenoid coil 30 of a relay 31; this action closes the relay switch 32, thereby permitting a current flow through conductors 33 and 34 from the rectifier section 35 into the current-processing section 36, enclosed by broken lines.

In the current-processing section 36 of the system circuit shown in FIG. 3, the current from the rectifier 35 (which is the current source for energizing all sections of the entire awakening system) passes through conductors 37 and 38 into a double-pole double-throw (DPDT) switch 39. Depending on the switch contact position of switch 39, which is manually operated to select a current therefrom, the current flows through either switch section 40, such as when section 40 is closed, as shown in FIG. 3, or through switch 41, when closed (thereupon, switch section 40 will be open).

If switch 39 is manually actuated so that the switch section 41 is closed, the current from conductor 38 flows through switch section 41, the current interrupter 42, into one side of telephone jack designated by 5,19, which are respectively shown in FIGS. 1 and 2 and in the schematic circuit diagram of FIG. 3. When the awakening module 8 is connected to telephone jack 5,19, the current from the jack flows through conductor 43 of electric cord 10 into the awakening module 44,8, wherein after passing through motor 56 winding 45 (FIG. 5) the current emerges into the cord 10 through conductor 46 to the other side of telephone jack 5,19, and conductors 47 and 48 to the relay switch 32 through the conductor 33. From the relay switch 32 (which is closed now, because of the audio signal received by microphone 3, as stated previously) the current passes through conductor 34 to conductors 49 and 50 back to the rectifier 35, thus completing the circuit, and energizing the awakening module 44,8. The energized module 44,8 will produce an undulatory, pulsative effect externally thereto. This latter effect creates the awakening stimuli in a person sleeping on a pillow with the awakening module 44,8 thereunder.

Following the descriptive scheme given in the preceding paragraph, if the switch contact section 40 of switch 39 is closed manually (opening contact section 41), the current from conductors 37 and 38 will flow through the variable resistor 51 (also shown in FIG. 2) to one side of telephone jack 5,19, conductor 43 of cord 10 into the awakening module 44 or 8. In this case, the continuous flow of current of variable intensity, due to variable resistor 51, into the awakening module 44,8 will produce a continuous vibration of the housing 52 (FIG. 5). This vibration can be utilized to massage tired muscles for relaxing and soothing them. Thus, by adjusting the vibration intensity by means of resistor 51, a person can obtain the desired vibrational intensity from module 44,8.

For employing the awakening system by means of an electric clock, the electric clock 14 is set to the desired time of awakening; the time is set the same as by an ordinary electric alarm clock. When the time of awakening arrives, the alarm-triggering mechanism of the clock 14 (see FIG. 4), which is connected to a normally-open miniature electric switch 53, such as a commercially available microswitch, closes the microswitch 53, which is represented by the open switch 53 in the schematic circuit diagram shown in FIG. 3. Upon closing of the microswitch 53, a current flows from the rectifier section 35 through conductors 37 and 38 to contact section 41 of the DPDT switch 39, since for awakening purposes the switch 39 is manually actuated so that the contact section 41 thereof is closed. The current from the contact section 41 of switch 39 is fed into a current interrupter 42, which interrupts the flow of the current from 30 to 60 times per minute, depending on the manufacturer's current interrupter type (which may be a commercial light flasher, a bimetallic thermosensitive switch, or a multivibrator). The interrupted current flows through conductor 55 to one terminal of telephone jack 5,19, from which it flows into the awakening module 44,8, and to one terminal of the energizing coil 45 of a motor 56 (FIG. 5), and leaves it through the other terminal conductor 46 (of electric cord 10) and passes through the opposite terminal of telephone jack 5,19 to conductors 47 and 57 to microswitch 53, which is located in abutment with the alarm-triggering lever 59 of the clock 14 mechanism (FIG. 4). The current continues from microswitch 53 through conductors 54 and 50 and returns to the opposite side of the rectifying section 35, thus completing the electrical circuit, and thereby exciting the awakening module 44,8 to an undulatory pulsative motion, which produces an awakening action in a person using the awakening module.

FIG. 4 illustrates the mechanical connection of the microswitch 53 lever 58 to the alarm-triggering lever mechanism 59 of clock 14. The solid lines by which the microswitch lever 58 and alarm-triggering lever 59 are shown illustrate the closed position of the microswitch 53, the projection 60 being current-closing lever of the microswitch 53. The structures designated by **59*a* and 58*a*, shown by broken lines, illustrate the normally open (inactive) positions of the respective structures 59 and 58. Numerals 54 and 57 designate the output conductors of the microswitch 53, also shown in FIG. 3. The designations 61 and 62 limited by broken lines respectively indicate the compartments 12 and 13 within the clock 14 (see FIG. 2); these compartments accommodate the electrical parts forming the respective circuits shown in the schematic circuit diagram of FIG. 3. The microswitch 53 closes when the alarm-triggering lever 59** is actuated by the clock mechanism when the time for awakening arrives.

FIG. 5 illustrates the arrangement of the various structural components of the awakening module 44,8. The electric current enters the module through conductors 43 and 46 enclosed in the sheathing of cable 10. The conductors carry either a continuous current, when the section 40 of DPDT switch 39 is closed, and a pulsative or repeatedly interrupted current when the section 41 of DPDT switch 39 is closed. In either case, the electric current energizes the direct current (DC) motor 56, causing its armature 63 together with its shaft 64 to rotate at high speed, up to 4000 RPM. At one terminal portion of shaft 64 is a metallic lump or weight 65 whose greater mass extends radially to one side of shaft 64 to produce an out-of-balance rotation of the shaft. This unbalance causes a vibrational effect in motor 56 during the shaft rotation. Since the motor housing 66 is embedded in a potting compound 67, such as a casting resin which is available commercially, in the housing 52 of the module 44,8, the vibratory effect of the motor is transmitted to the housing 52. This vibrational effect is used to relax and sooth tired muscles. However, when the current transmitted into the motor 56 is periodically interrupted, as by current interrupter 42, the recurrently interrupted current in motor 56 produces an additional unbalance in module 44,8; the two unbalanced forces acting at right angles upon the module housing 52 create a resultant force, which is undulatory and pulsative, similar to throbbing, causing the housing 52 to execute throbbing motion of moderate intensity. By making a slight bend in the shaft 64 adjacent the mass 65, the pulsative effect is magnified. The latter effect is utilized to awaken a person, when the module 44,8 is placed under the pillow of the sleeping person.

As stated earlier, the system receives a current from an external source, such as a 115-volt 60-cycle household current, and converts it into a nominally 6-volt direct current for the operation of all cooperative parts in the circuit. A step-down voltage transformer 68, whose primary winding 69 is connected to the 115-volt alternating current; its secondary winding 70 is connected across the two terminals 71 and 72 of the rectifier section 35, which comprises the four diode rectifier arranged in a full-wave connection. Other rectifiers, such as copper oxide plates can also be used.

It is thus seen from the preceding description that the silent (without sound) awakening in a sleeping person can be brought about by either an electric clock set to a predetermined time to trigger the awakening system or by the sound of a smoke/fire detection alarm, a door bell, ringing of a telephone bell, or other similar sounds sensed by the sound-operated switch means herewith described.

The disclosure of the invention described hereinabove represents the preferred embodiments of the invention; however, variations thereof, in the form, construction, and arrangement of the various electronic components thereof and the modified application of the invention are possible without departing from the spirit and scope of the appended claims.

I claim:

1. A silent awakening system, comprising: a first means adapted to receive an acoustic signal and to convert said acoustic signal into an electrical signal, an electric amplifying means connected to said first means and having an electric circuit therein to amplify and transmit said electrical signal to an electric relay means for operation thereof, a second means, in electrical connection with said first means, receiving an alternating current from an external source and adapted to convert said alternating current into a direct current for energization of said first means, and a third electric circuit means connected to said second means to receive therefrom a direct current through said electric relay means therein to electrically process said direct current; said third electric circuit means having in the current-processing circuit thereof a current-interrupting means, a variable current control means disposed therein in electrically parallel relation to said current-interrupting means, and a current-switching means, connected between the electrically parallel sections comprising said current-interrupting means and said variable current control means, to channel the direct current supplying said electrically parallel section into one or the other of said electrically parallel sections; and, an awakening module in electrical connection with said third electric circuit means through said current outlet means to receive an electric current therefrom for operation of said awakening module by the actuation of said electric relay means upon reception of an acoustic signal by said first means.

2. A silent awakening system as defined in claim 1, wherein said first means comprises a housing with a compartment therein, an electric circuit is disposed in said compartment and receives an electric current from an external source, an electric relay provided in said electric circuit at the output section thereof, an acoustic receptor means disposed in the wall of said housing and connected to said electric circuit for transmission of an electric current therefrom to said electric relay for actuation thereof when said acoustic receptor means receives a sound signal from a fire-detector alarm, a telephone bell, and the like.

3. A silent awakening system as described in claim 1, wherein said second means comprises a step-down transformer having the primary coil thereof connected to a 115-volt alternating current and the secondary coil thereof connected to a full-wave rectifying circuit in electrical connection with said first means to energize said first means for actuation of the electric relay means connected thereto.

4. A silent awakening system as described in claim 2, wherein said housing is provided in one wall thereof a switch means electrically connected between the electric circuit disposed in the compartment of said housing and the electric relay to activate and deactivate said electric relay.

5. A silent awakening system as described in claim 2, wherein said electric circuit disposed in the compartment of said housing is provided with a current-processing section connected in electrical relation to said electric circuit through said electric relay to receive an energizing current therefrom when an acoustic signal is received by the acoustic receptor means thereof disposed in the wall of said housing.

6. A silent awakening system as described in claim 5, wherein said current-processing section of the electric circuit disposed in said housing is provided with an electrically parallel circuit section for processing the current received thereby through the electric relay and a current outlet means in the form of a telephone jack connected to said electrically parallel circuit section is disposed in the wall of said housing whereby the processed current in said current-processing section can be transmitted externally thereto through said telephone jack.

7. A silent awakening system as described in claim 6, wherein said current outlet means receiving a processed current from the current-processing electrically-parallel circuit section transmits said processed current to an awakening unit detachably connected thereto through the telephone jack for energization of said awakening unit.

8. A silent awakening system as described in claim 1, wherein said silent awakening system is provided with means to house said first means, said second means, and said third electric circuit means electrically connected theretogether to produce an output signal therefrom, means to receive said output signal for transmitting it to an awakening unit detachably connected to said means receiving said output signal to produce in said awakening unit an undulatory motion for awakening a sleeping person employing said awakening unit under his bed pillow.

9. A silent awakening system as described in claim 5, wherein said housing is provided in the wall thereof with a double-pole double-throw switch means connected to the electrically parallel circuit section disposed in said housing to transmit from said electrically parallel circuit section a current from either branch circuit thereof to the telephone jack disposed in the wall of said housing.

10. A silent awakening system as described in claim 1, wherein said first means is provided with a housing having therein an electrical circuit comprising an amplifying means, an electric relay connected to said amplifying means, a current-rectifying circuit receiving an alternating current from an external source to convert said alternating current into a direct current of lower voltage than that supplied by said external source and to transmit said direct current to said amplifying means for energization thereof, a current-processing circuit connected to said current-rectifying circuit and receiving a direct current therefrom, and a current outlet means disposed in the wall of said housing and electrically connected to the output section of said current-processing circuit to receive a processed current therefrom; an awakening module having an electric cord extending therefrom with means at the distal end thereof for connecting said awakening module to said current outlet means to receive an energizing current therefrom.

11. A silent awakening system described in claim 10, wherein said current-processing circuit comprises two sectional circuits connected theretogether in an electrically parallel relation; one of said sectional circuits has in the circuit thereof a current interrupter to interrupt the current passing therethrough from 30 to 60 times per minute, and the other sectional circuit is provided therein with a variable resistance means for increasing or decreasing the current intensity therethrough; said sectional circuits have a common current outlet means disposed in the wall of the housing of the first means for transmitting through said common current outlet means either an interrupted current or a continuous current of varying intensity as adjusted by said variable resistance means to an awakening unit detachably connected to said common current outlet means for energization of said awakening unit.

12. A silent awakening system as defined in claim 1, wherein said silent awakening system comprises a sonic means for detecting audible signals and converting said audible signals into electric signals, means, connected to said sonic means, for amplifying said electrical signals and having in the circuit thereof an open-circuit electric relay means, means for receiving a supply current from an external source and being in electrical relation with said sonic means and said means for amplifying said electrical signals for energization thereof, an electric timing unit having therein an alarm-triggering means and a current control means mechanically connected to said alarm-triggering means for actuation thereby; said electric timing unit is connected to said means for receiving a supply current from an external source, and an electric circuit means connected to said means for amplifying said electrical signals and adapted to receive the amplified electrical signals therefrom for processing them to an electric current form usable by an awakening means in electrical connection with said electric circuit means through a detachable electric conductor thereof; said awakening means is energized when an electric current from said electric circuit means flows thereinto upon actuation of either said current control means by said alarm-triggering means disposed in said electric timing unit or of said open-circuit electric relay means receiving an electrical signal from said means for amplifying electrical signals upon detection by said sonic means of an audible sound from an external source.

13. A silent awakening system as defined in claim 12, wherein said awakening means comprises means for producing therein a throbbing action and thereby creating awakening stimuli in said awakening means, said awakening means being adapted to be placed under the pillow of a sleeping person for transmitting thereto, through said pillow, awakening stimuli produced in said awakening means.

* * * * *